US006733399B2

(12) United States Patent
Koncelik, Jr.

(10) Patent No.: US 6,733,399 B2
(45) Date of Patent: May 11, 2004

(54) SPORTING EQUIPMENT AUDIBLE DEVICE

(76) Inventor: Lawrence J Koncelik, Jr., 10 Gingerbread La., East Hampton, LI, NY (US) 11937

( * ) Notice: Subject to any disclaimer, the term of this patent is extended or adjusted under 35 U.S.C. 154(b) by 0 days.

(21) Appl. No.: 10/422,511

(22) Filed: Apr. 24, 2003

(65) Prior Publication Data

US 2003/0195063 A1 Oct. 16, 2003

Related U.S. Application Data

(62) Division of application No. 09/867,215, filed on May 29, 2001, now Pat. No. 6,692,370.

(51) Int. Cl.[7] ..... A63B 69/36

(52) U.S. Cl. ..... 473/219; 473/226; 473/228; 473/234

(58) Field of Search ..... 473/219, 228, 473/224, 234, 242, 226; 116/174

(56) References Cited

U.S. PATENT DOCUMENTS

| | | | | | |
|---|---|---|---|---|---|
| 1,069,776 | A | * | 8/1913 | Foulis | 116/174 |
| 1,171,699 | A | | 2/1916 | Brown | |
| 1,519,052 | A | | 12/1924 | Reach | |
| 2,688,303 | A | * | 9/1954 | Leander | 116/173 |
| 2,771,678 | A | | 11/1956 | Hansen, Sr. | |
| 2,898,109 | A | | 8/1959 | Williams | |
| 3,262,705 | A | | 7/1966 | Nuziato | |
| 3,565,444 | A | | 2/1971 | Larocca | |
| 3,715,821 | A | * | 2/1973 | Hawes | 40/591 |
| 3,776,556 | A | | 12/1973 | McLaughlin | |
| 4,204,332 | A | | 5/1980 | Gray | |
| 4,227,406 | A | | 10/1980 | Coffey | |
| 4,236,271 | A | | 12/1980 | Martino | |
| 4,257,607 | A | | 3/1981 | Nedwick | |
| 4,576,378 | A | | 3/1986 | Backus | |
| 4,601,255 | A | * | 7/1986 | Marcotti | 116/173 |
| 4,603,652 | A | * | 8/1986 | Thibault et al. | 116/174 |
| 4,813,369 | A | | 3/1989 | Moreland | |
| 4,875,431 | A | | 10/1989 | Dobosz | |
| 4,901,662 | A | | 2/1990 | Sandeen et al. | |
| 4,984,379 | A | * | 1/1991 | Lee | 40/334 |
| 5,029,854 | A | | 7/1991 | Laskowitz et al. | |
| 5,174,577 | A | | 12/1992 | Warde et al. | |

(List continued on next page.)

*Primary Examiner*—Sebastiano Passaniti
(74) *Attorney, Agent, or Firm*—Walter J. Tencza, Jr.

(57) ABSTRACT

The present invention 10 discloses a device that attaches to sporting equipment for the purpose of generating an audible sound under predetermined conditions. The device 10 is selectively attached to hand held sporting equipment, such as a golf club 18 and tennis racquet 38, that travels through a sweeping motion. By attachment of the sound generating device to the aforementioned equipment it will be possible to cause audible sounds under abrupt increases in velocity. The device of the preferred embodiment is comprised of a sound generation element 12 such as pliable material, and may include a means of attachment element 14. The sound generation element 12 can be permanently or semi-permanently fixed to the sporting equipment. In the permanent/semi-permanent state the sound generation element is fixedly positioned by means of adhesive 40, or any other bonding means known within the art, to the sporting equipment thereby having no need for a means of an attachment element 14. The means of attachment element 14 provides for selective attachment and detachment of the sound generating device and is comprised of a snap-on collar or clip 24 and alternately of lengths of material 22 that can be twisted or tied around a portion of the sporting equipment. The clip 24 is a substantially cylindrical object having a slotted aperture 28 formed by flexible divergent arms 26 enclosing a throughbore whereby the clip can be pressed onto sporting equipment.

9 Claims, 16 Drawing Sheets

U.S. PATENT DOCUMENTS

| | | | |
|---|---|---|---|
| 5,184,825 | A | 2/1993 | Ruth |
| 5,207,174 | A | 5/1993 | Fabbrini |
| 5,228,695 | A | 7/1993 | Meyer |
| 5,273,278 | A | 12/1993 | Beeker |
| 5,310,188 | A | 5/1994 | Hernberg |
| 5,335,918 | A | 8/1994 | Rupnik et al. |
| 5,398,928 | A | 3/1995 | Rudell et al. |
| 5,400,437 | A | 3/1995 | Koutras |
| 5,423,281 | A | 6/1995 | Crookham |
| 5,517,941 | A | 5/1996 | Fisher |
| 5,527,039 | A | 6/1996 | Levesque |
| 5,571,048 | A | 11/1996 | Kenney |
| 5,658,205 | A | 8/1997 | Bartscherer |
| 5,984,799 | A | 11/1999 | Romano |
| 6,045,364 | A | 4/2000 | Dugan et al. |
| 6,238,299 | B1 | 5/2001 | Barnette |

* cited by examiner

SPORTING EQUIPMENT AUDIBLE DEVICE

CROSS REFERENCE TO RELATED APPLICATIONS

This present patent application is a divisional of and claims the priority of U.S. patent application Ser. No. 09/867,215 now U.S. Pat. No. 6,692,370, titled "Sporting Equipment Audible Device", filed on May 29, 2001 and claims the priority of PCT patent application, International application No. PCT/US01/26686, titled "Sporting Equipment Audible Device" filed on Aug. 28, 2001.

BACKGROUND OF THE INVENTION

FIELD OF THE INVENTION

The present invention relates generally to sporting equipment and more specifically to a device that can be selectively attached to some sporting equipment for the purpose of generating an audible sound under predetermined conditions.

The sound-generating device of the present invention is attached to hand held sporting equipment that travel through a sweeping motion, such as golf clubs and tennis racquets. By attachment of the sound-generating device to the aforementioned equipment it will be possible to cause audible sounds during predetermined velocities of the sound-generating device.

SUMMARY OF THE PRESENT INVENTION

The present invention discloses a device that attaches to sporting equipment for the purpose of generating an audible sound under predetermined conditions. The device is selectively attached to hand held sporting equipment, such as a golf club and tennis racquet, that travels through a sweeping motion. By attachment of the sound-generating device to the aforementioned equipment it will be possible to cause audible sounds under abrupt increases in velocity. The device is comprised of a sound generation element and may include a means of attachment element.

The preferred embodiment of the present invention is a sound generation element comprised of a planar sheet of polyester film having an amount of adhesive along one side of said polyester film with a peelable protective element covering the adhesive. The device is fixed to the sporting equipment by removing the adhesive protective element and placing the device in contact with the sporting equipment. The device is wrapped around the sporting equipment with the adhesive element being a fixed to a part of the planar sheet of polyester. The adhesive does not come into contact with the sporting equipment. Thereby the device is free to rotate about the sporting equipment during use.

In another embodiment of the present invention, the device incorporates a means of attachment element. The means of attachment element provides for selective attachment and detachment of the sound generating device and is comprised of a snap-on collar or clip and alternately of lengths of material that can be twisted or tied around a portion of the sporting equipment. The means for attachment element can be lengths of suitable material, such as cord or wire reinforced cord, having the sound generation element fixedly positioned thereto with sufficient free end lengths that can pass around a selected point on the sporting equipment and tied or twisted as means for securing the sound generation element to the sporting equipment. As an alternate means of securing the sound-generating element to the sporting equipment, a clip is provided. The clip is a substantially cylindrical object having a slotted aperture formed by flexible divergent arms enclosing a throughbore whereby the clip can be pressed onto sporting equipment. The flexible divergent arms aid in the removal of the device from the sporting equipment.

An additional element is provided for the sound generation element in the form of a planar somewhat rigid pliant material such as paper or plastic. That can be attached permanently or semi-permanently by any means known with the art, such as adhesively. Using a means of attachment element, such as a clip, enables selective attachment and removal of the sound generation device.

The sound generation element has a clip mating member formed on one edge. The clip mating member Is inserted into a channel or aperture within the clip. The length of the sound generation element can be adjusted by wrapping said element around the clip mating member prior to insertion in the clip.

The purpose of the sound generation device of the present invention is to provide means whereby a golfer may accurately determine whether he is accelerating the club at a proper point of the swing or during the wrong part of a swing or at the top of the back swing. If the golfer jerks the club back or hits from the top, the sound generation element will make a loud flutter sound at the point of incorrect acceleration. If the swing is correct, the sound generation element will only make the flutter sound at impact of the swing. The size of the flutter flag is inversely proportional to the speed at which is the flutter.

A primary object of the present invention is to provide a sound generation device that can be attached to selective sporting equipment.

Another object of the present invention is to provide a sound generation device that will interact with atmospheric air during a sweeping motion while attached to sporting equipment to generate sound.

Yet another object of the present invention is to provide a sound generation device that can be permanently or semi-permanently attached to sporting equipment.

Still yet another object of the present invention is to provide a sound generation device that can be selectively attached and removed from sporting equipment.

Another object of the present invention is to provide a sound generation device having a sound generation element.

Yet another object of the present invention is to provide a sound generation element that can be fixedly attached to sporting equipment by means of adhesive.

Still yet another object of the present invention is to provide a sound generation element that can be attached to sporting equipment by means of an attachment element.

Another object of the present invention is to provide a sound generation device having a sound generation element and a means of attachment element.

Yet another object of the present invention is to provide a sound generation device comprising a sound generation element formed from a semi-rigid planar material such as, paper, Mylar or nylon or other polyester film.

Still yet another object of the present invention is to provide a sound generation attachment element for a sound generation element comprising lengths of suitable material such as cord or wire reinforced line that can be tied or twisted about sporting equipment as means of securement.

Another object of the present invention is to provide an attachment element for a sound generation element comprised of a cylindrical member having a slotted aperture that can be pressed on sporting equipment.

Yet another object of the present invention is to provide an attachment element having cylindrical walls with opposing divergent arms forming a slotted aperture that can be pressed on sporting equipment.

Still yet another object of the present invention is to provide a sound generation element having a post fixedly attached to one edge of the sound generation element and forming an integral part therewith.

Another object of the present invention is to provide a sound generation element having a post whereby the sound generation element can be inserted into an attachment element and selectively removed therefrom.

Yet another object of the present invention is to provide a sound generation element and an attachment element that form a sound generation device.

Still yet another object of the present invention is to provide a sound generation element that can be adjustably mounted to vary the length of said sound generation element.

Additional objects of the present invention will appear as the description proceeds.

The present invention overcomes the shortcomings of the prior art by providing a sound generating device having a sound generation element that can be permanently/semi-permanently attached to hand held sporting equipment that will generate a sound during an accelerated sweeping motion.

The sound generation element can be formed from a semi-rigid pliant material. The aforementioned sound generation elements can be selectively attached to hand held sporting equipment by means of an attachment element.

The attachment element can form an integral part of the sound generation element, such as length of suitable material bonded to the sound generation element that can be positioned to straddle a portion of the sporting equipment and tied or twisted forming closure and attachment to the sporting equipment.

Alternately the attachment element can be a clip that can be pressed onto selective sporting equipment.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

List of Reference Numerals

Figure 1:
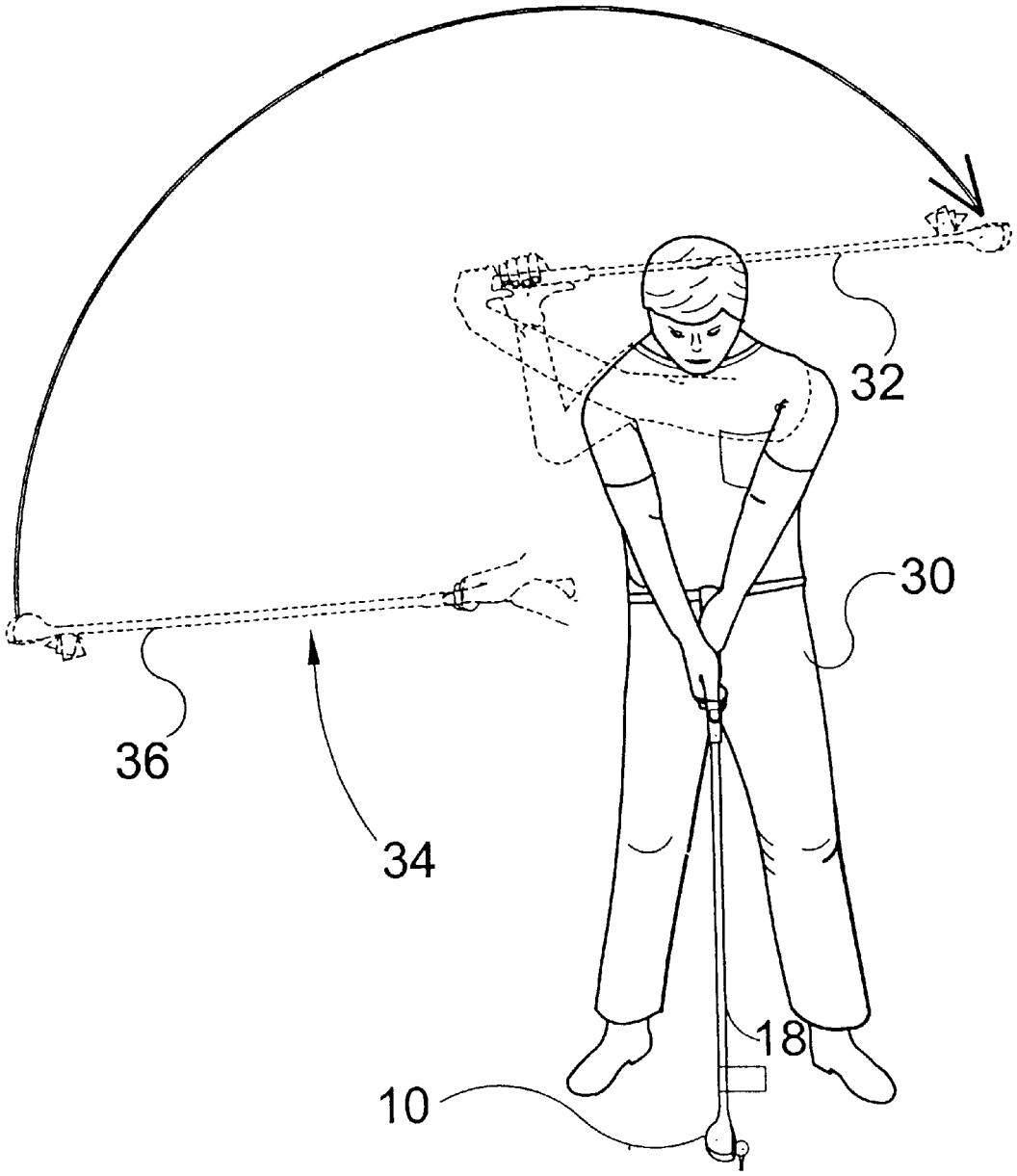
FIG. 1 is an illustrative view of the present invention in use.

With regard to reference numerals used, the following numbering is used throughout the drawings.

10 present invention
12 sound generation element
14 sound generation attachment element
18 golf club
20 golf club shaft
22 wire reinforced line
24 clip
26 arm of clip
28 aperture
30 golfer
32 point of back swing
34 point of incorrect acceleration
36 point of flutter sound
38 tennis racquet
40 adhesive material
42 clip mating member
44 slot
46 post
48 wall
50 small clip
52 hook and loop material

DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning to FIG. 1, shown therein is a perspective view of the present invention 10 disposed on a golf club 18 having a sound generation element attached thereto whereby a golfer 30 will cause the sound generation element to emit a sound by jerking the golf club 18 during the top of the back swing. If the golfer 30 jerks the golf club 18 back at the back swing point 32 or has incorrect acceleration at point 34, e.g., a flutter sound or other sound will be emitted at point 36.

Figure 2:
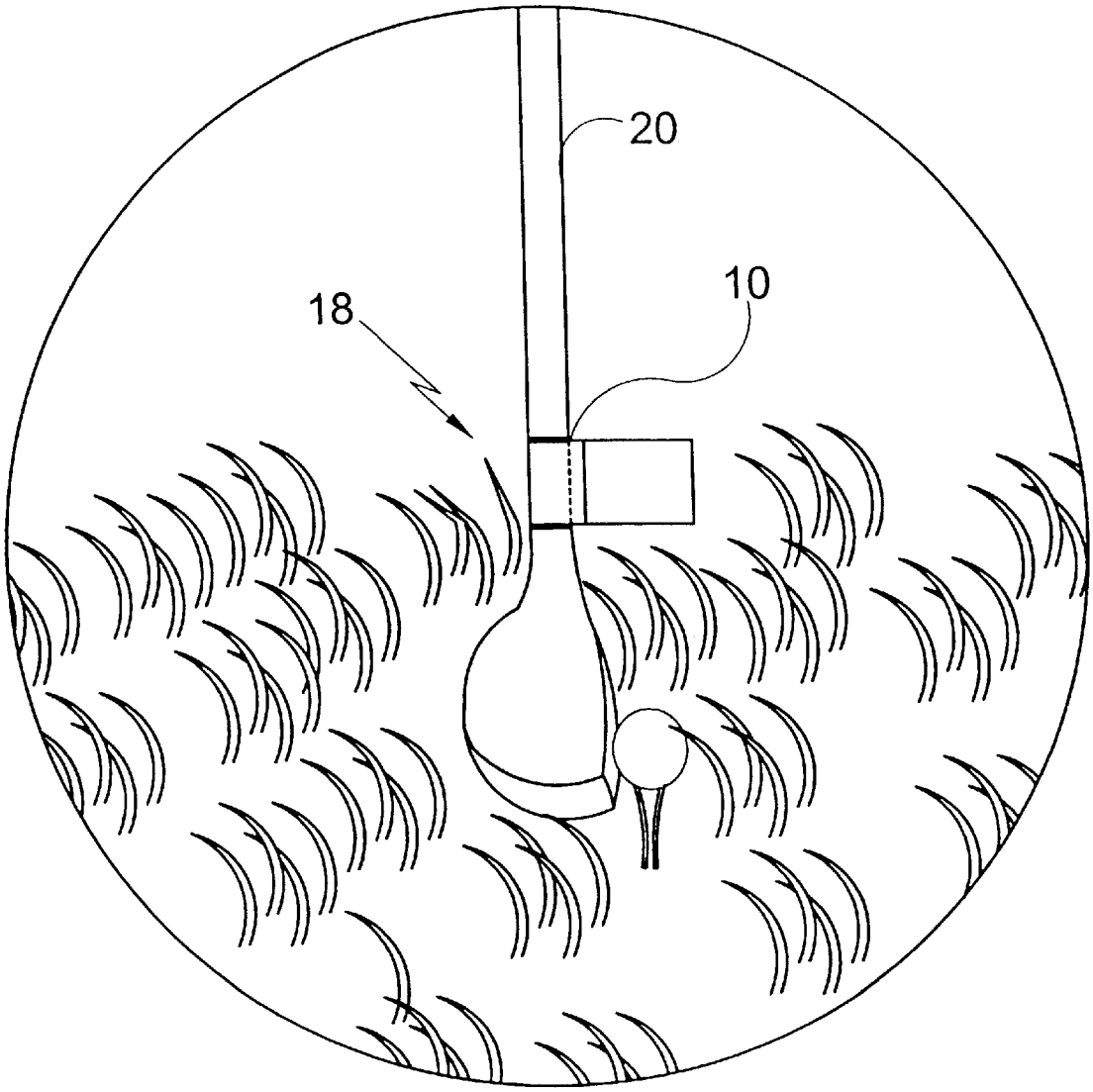
FIG. 2 is a perspective view of the sound generation element of the present invention having an amount of adhesive on a portion thereof.

Turning to FIG. 2, shown therein is a perspective view of the present invention 10 attached to the shaft 20 of a golf club. The sound generation element may be made of a stiff pliant material, such as paper or plastic or the like that is fixed to the golf club shaft 20 for the purpose of generating a sound under predetermined conditions during a sweeping motion of the golf club 18.

Figure 3:
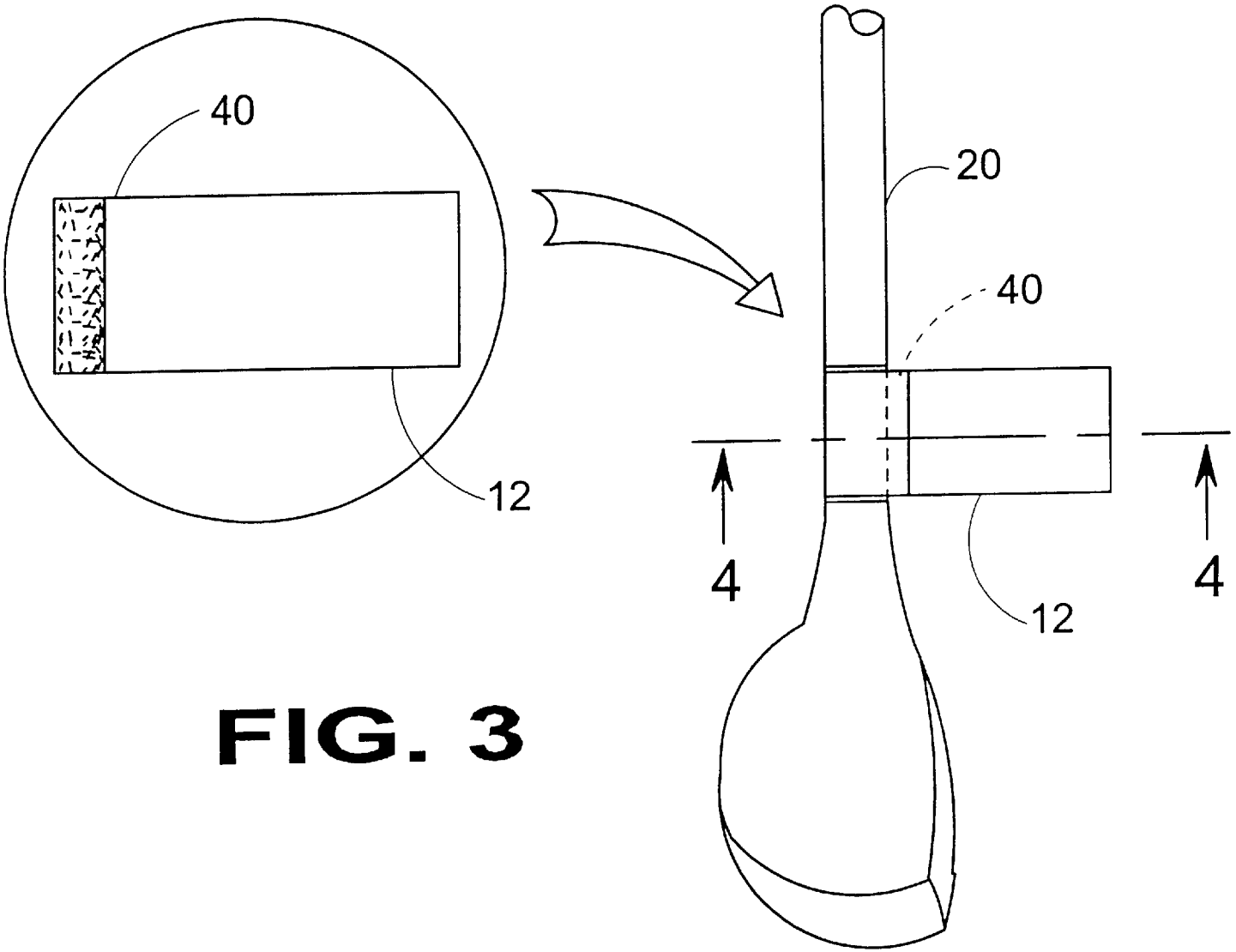
FIG. 3 is a perspective view of the sound generation element of the present invention wrapped around a golf club shaft.

Turning to FIG. 3, shown therein is a perspective view of the present invention 10 showing the sound generation element 12 having a partial layer of adhesive material 40 on one portion thereof. The adhesive material will bond the sound generation element 12 to, e.g., a golf club shaft 20, by being wrapped around the shaft 20.

Figure 4:
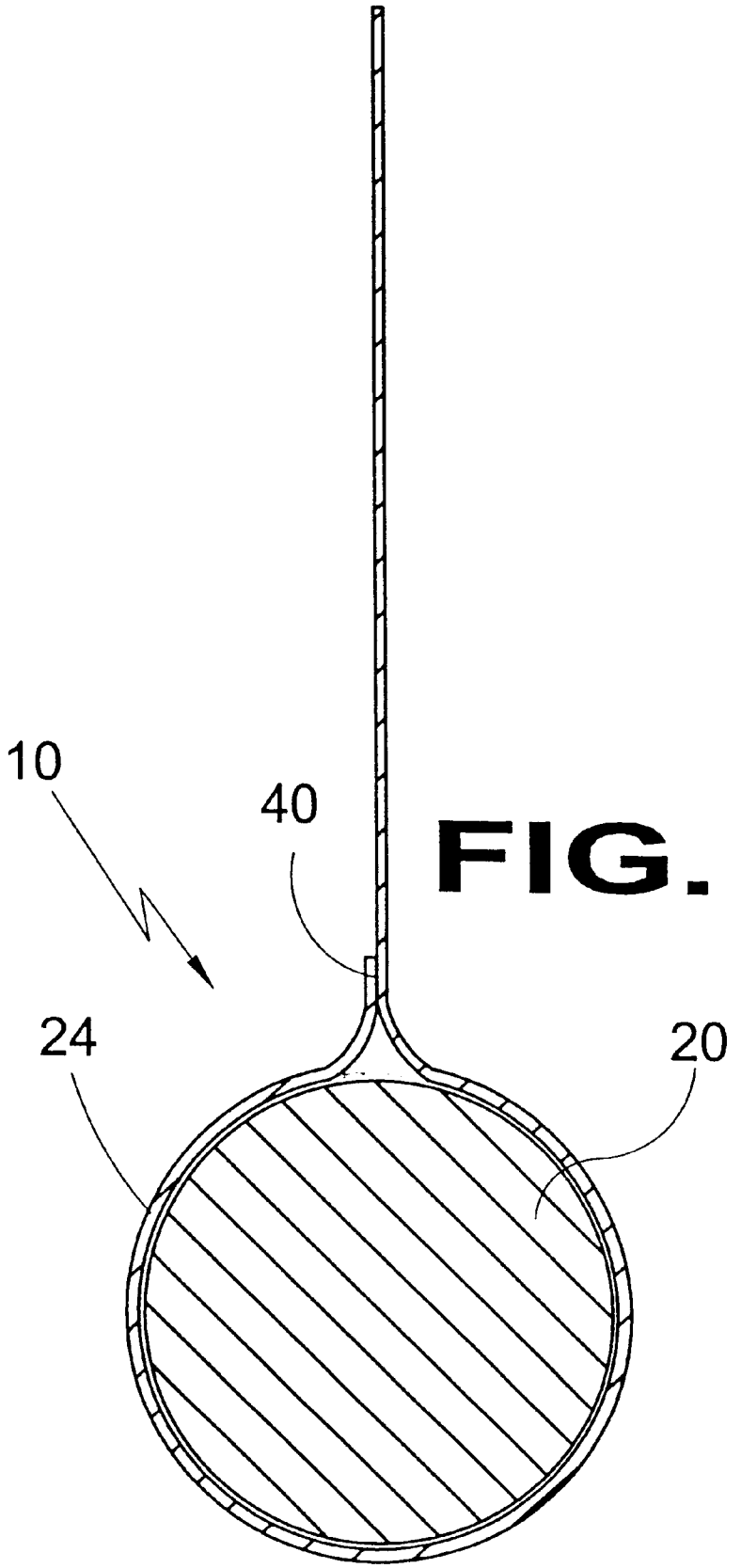
FIG. 4 is a cross sectional view of the present invention taken from FIG. 3 as indicated.

Turning to FIG. 4, shown therein is a view of the sound generation device of the present invention 10 attached to shaft 20. The sound generation element 12 is wrapped around the shaft 20 and adhesively attached to itself. The sound generation element 12 encloses shaft 20 without being affixed thereto. Thereby the sound generation element 12 is able to freely rotate around shaft 20. During use of the present invention the sound generation 12 will rotate around shaft 20 lagging during a sweeping motion.

Figure 5:
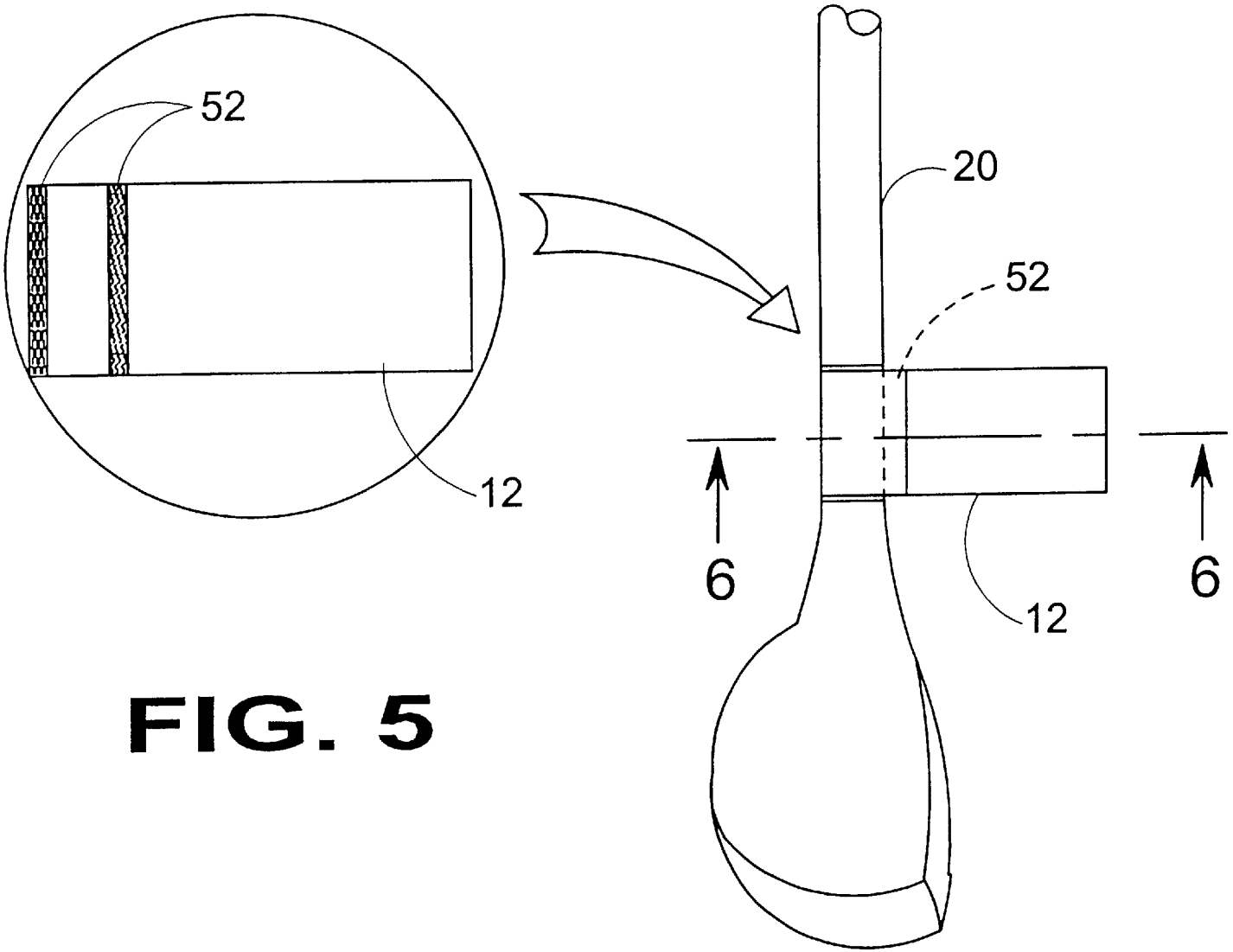
FIG. 5 is a perspective view of the sound generation element of the present invention wrapped around a golf club shaft.

Turning to FIG. 5, shown therein is a perspective view of the present invention 10 showing the sound generation element 12 having a mating hook and loop material 52 on one end thereof. The hook and loop material is spaced apart so that a golf club shaft can be placed between said mating members whereupon said mating members will be engaged enclosing the golf club shaft therein. The sound generation element 12 having been releasably fixed to golf club shaft 20 has sufficient circumference to freely rotate about club shaft 20.

Figure 6:
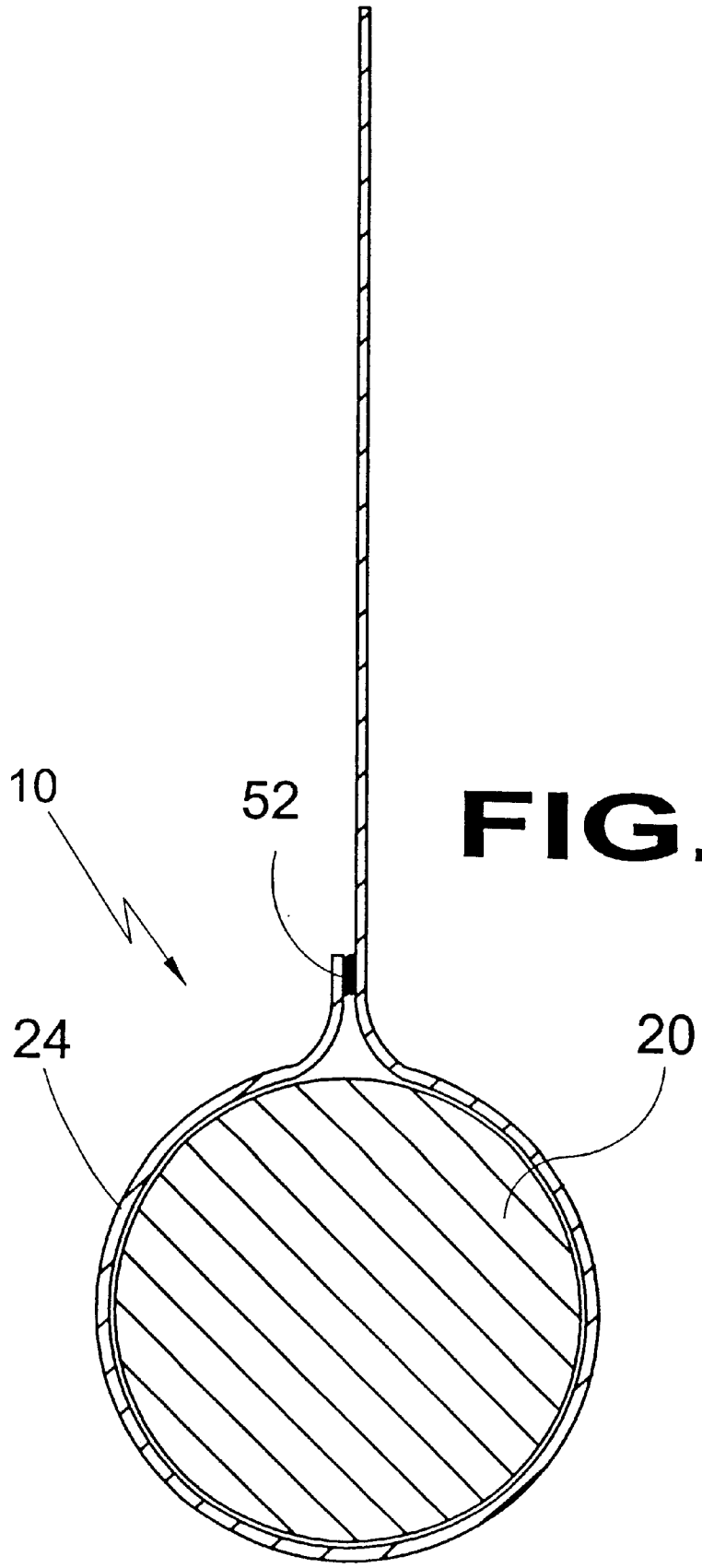
FIG. 6 is a cross sectional view of the present invention taken from FIG. 5 as indicated.

Turning to FIG. 6, shown therein is a view of the sound generation device of the present invention 10 attached to a shaft 20. The sound generation element 12 is wrapped around the shaft 20 and the mating hook and loop material 52 is attached to itself enclosing shaft 20 without being affixed thereto. Thereby the sound generation element 12 is able to freely rotate around shaft 20. During use of the present invention the sound generation 12 will rotate around shaft 20 lagging during a sweeping motion.

Figure 7:
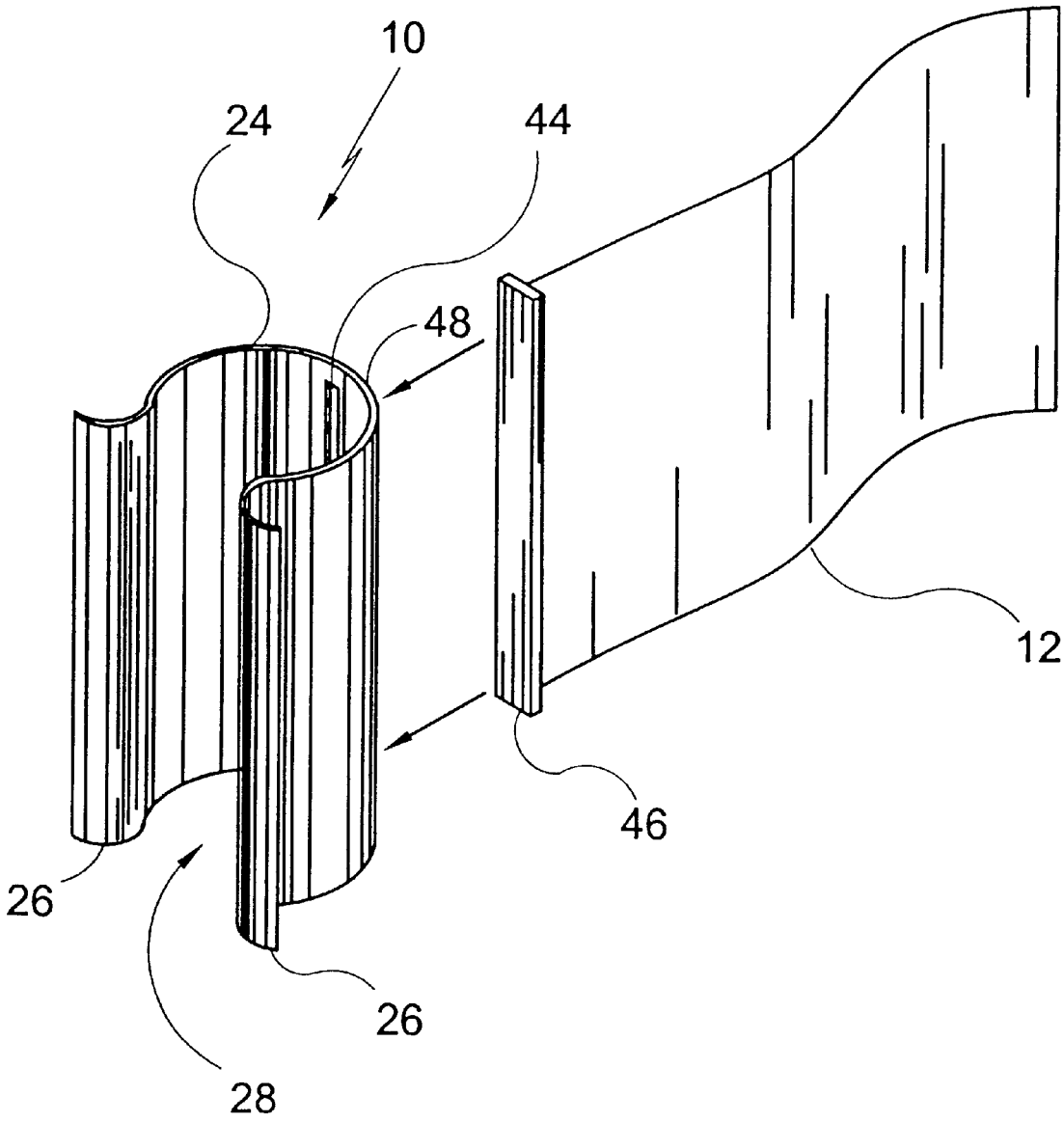
FIG. 7 is a perspective view of the sound generation device of the present invention.

Turning to FIG. 7, shown therein is a perspective view of the sound generation device of the present invention 10. The sound generation element 12 being of a semi-rigid pliant material is fixed to a post 46 which is attached to the means of attachment element being a clip 24. The clip 24 has a slotted aperture 44 in the wall 48 thereof wherethrough the post 46 of the sound generation element can be inserted and retained thereby. The clip 24 has a slotted aperture 28 formed by divergent arms 26 whereby the clip attachment element can be pressed onto sporting equipment. The divergent arms 26 provide means for easily dismounting the sound generation element from the sporting equipment.

Figure 8:
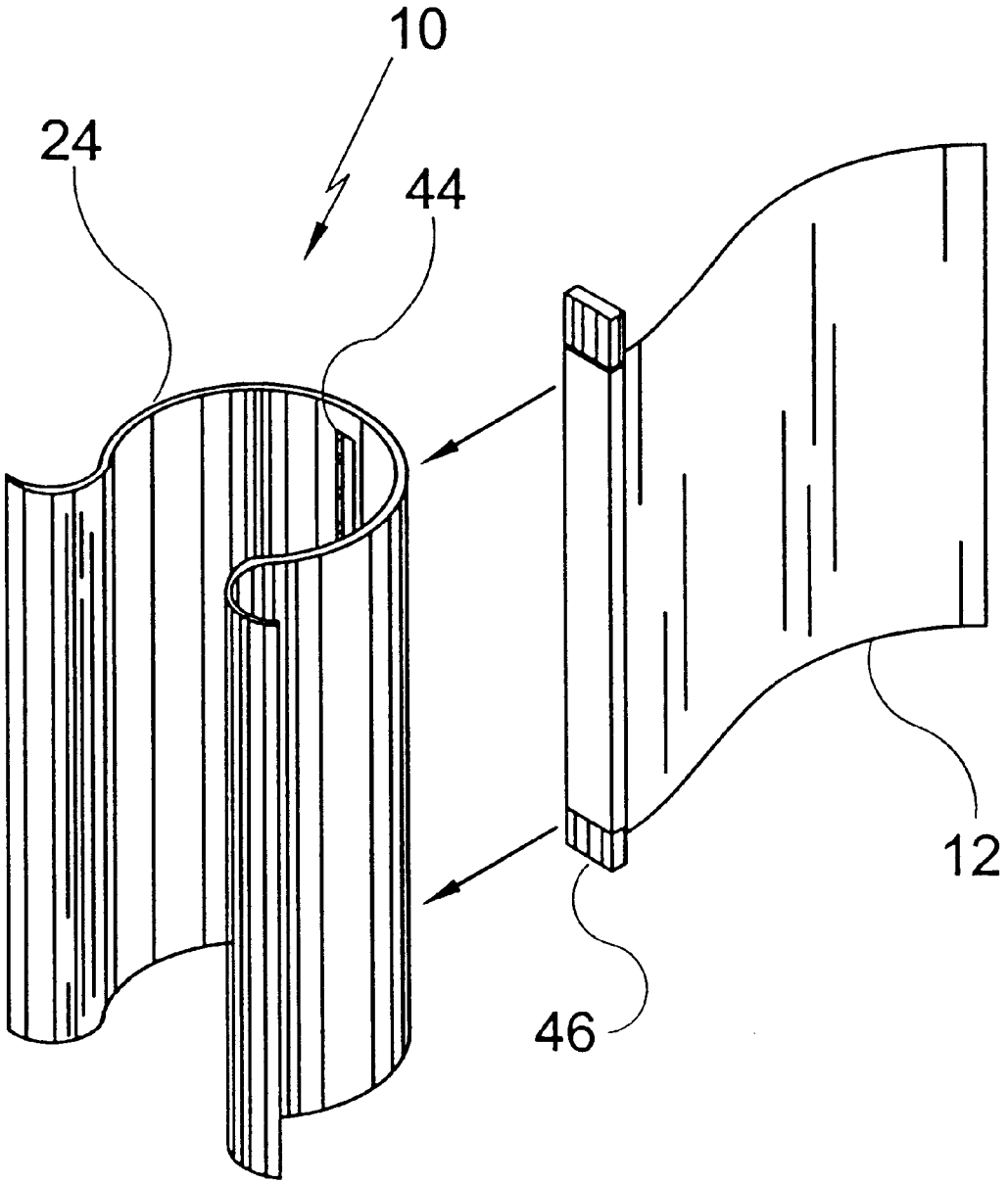
FIG. 8 is a perspective view of the sound generation device with an attachment clip.

Turning for FIG. 8, shown therein is a perspective view of the sound generation device of the present invention 10 showing the sound generation element 12 wrapped around the post 46 a selective number of times whereby the length of the sound generation element 12 can be varied. Other elements previously disclosed are also shown.

Figure 9:
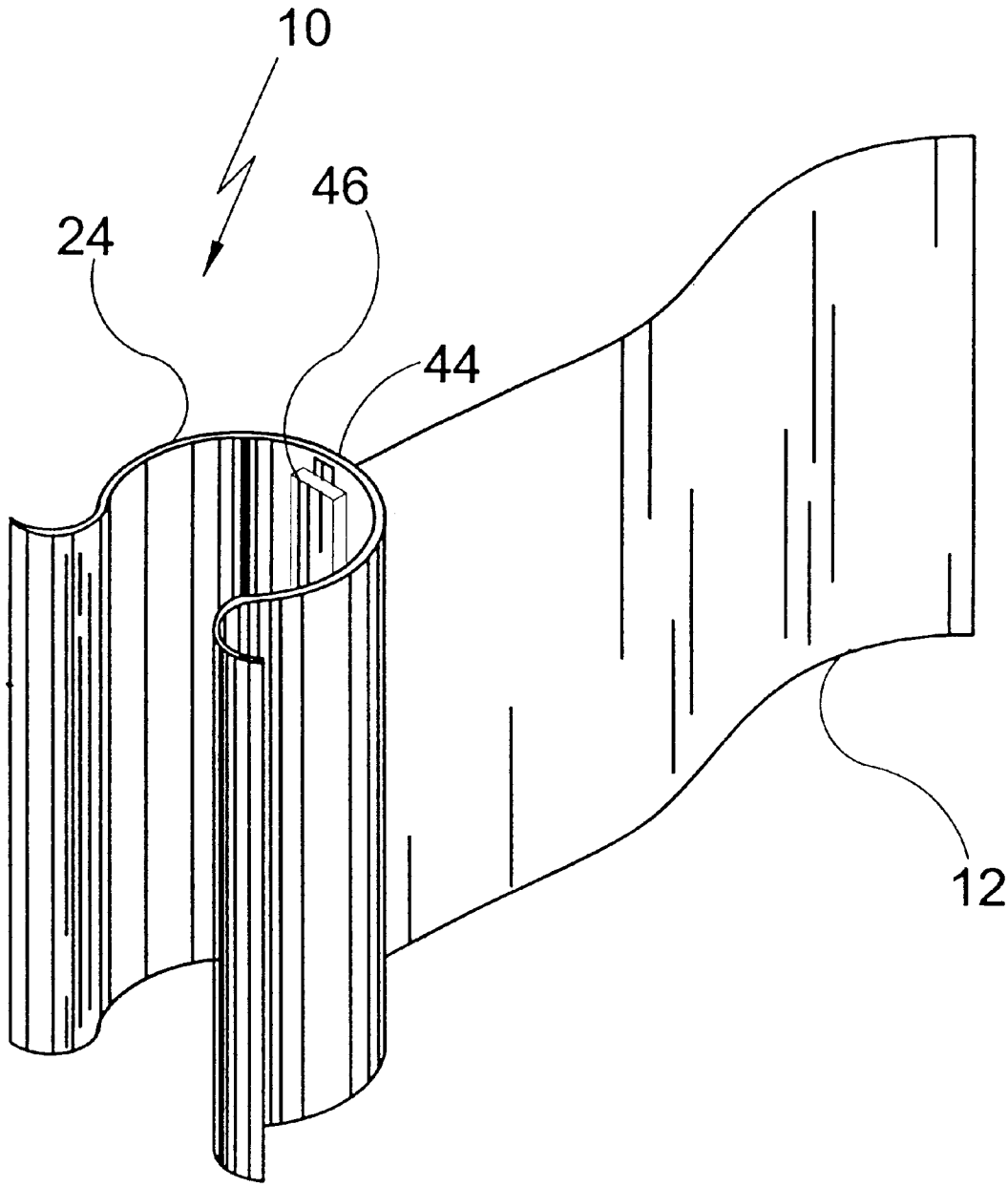
FIG. 9 is a perspective view of the sound generation element with an attachment clip.

Turning to FIG. 9, shown therein is a perspective view of the sound generation device of the present invention 10 showing the sound generation element 12 wherein the post 46 is inserted into a slotted aperture 44 within the wall of the means of attachment element 24. The means of attachment element 24 grips a portion of sporting equipment, such as a golf club. The means of attachment clip 24 can be rotated upon the sporting equipment through a predetermined number of degrees whereby the sound generation element 12 can be rotated to generate a sound through a sweeping motion in either of the back swing or fore swing of a golf club.

Figure 10:
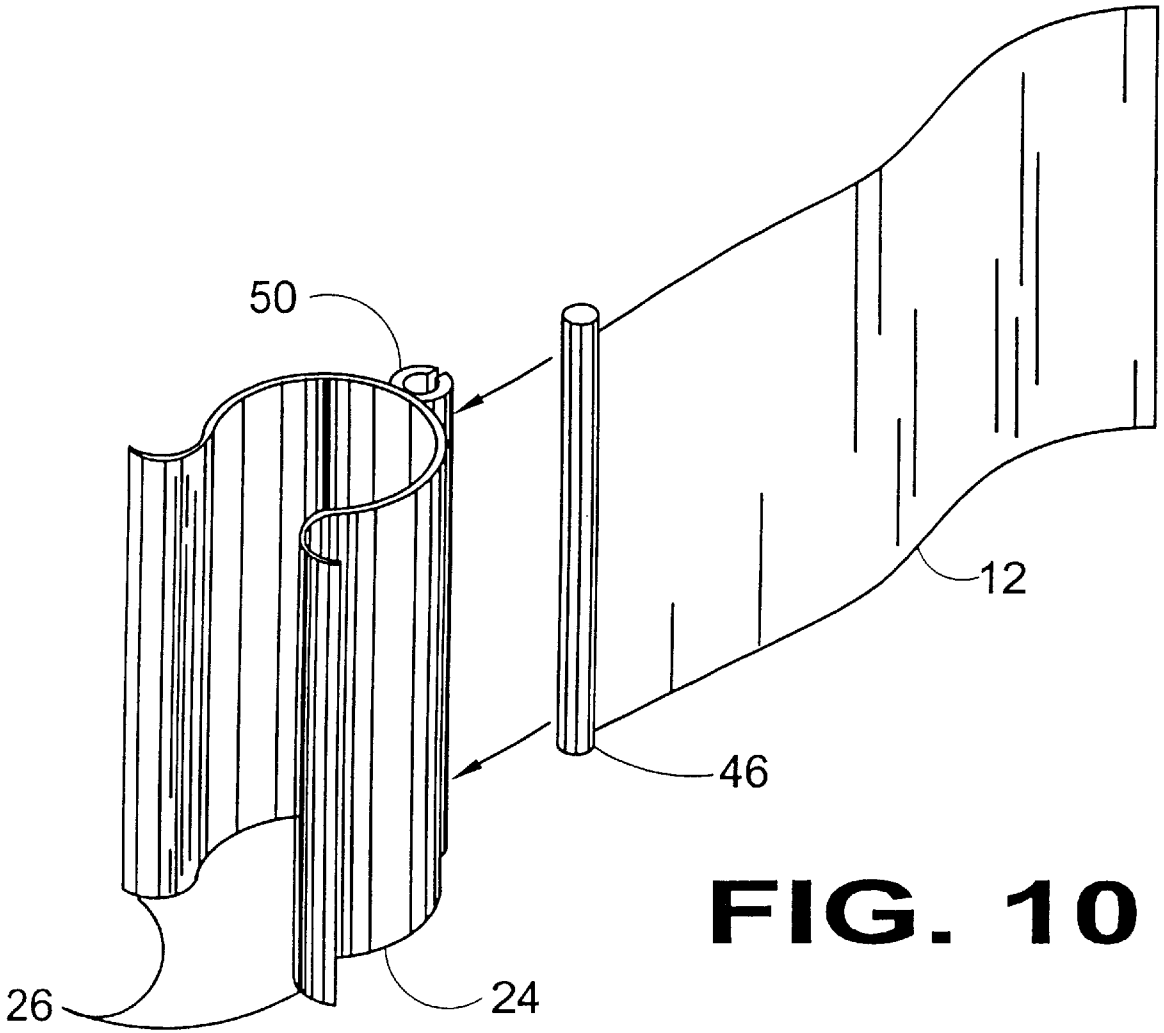
FIG. 10 is a perspective view of the sound generation element with an attachment clip.

Turning to FIG. 10, shown therein is a view of the sound generation device of the present invention 10. The sound generation device is comprised of a sound generation element 12 being a length of semi-rigid pliant material fixedly attached to a post 46 which forms a sound generation attachment element mating member for insertion into a small clip 50 disposed on the back of the large clip 24 opposite to arms 26.

Figure 11:
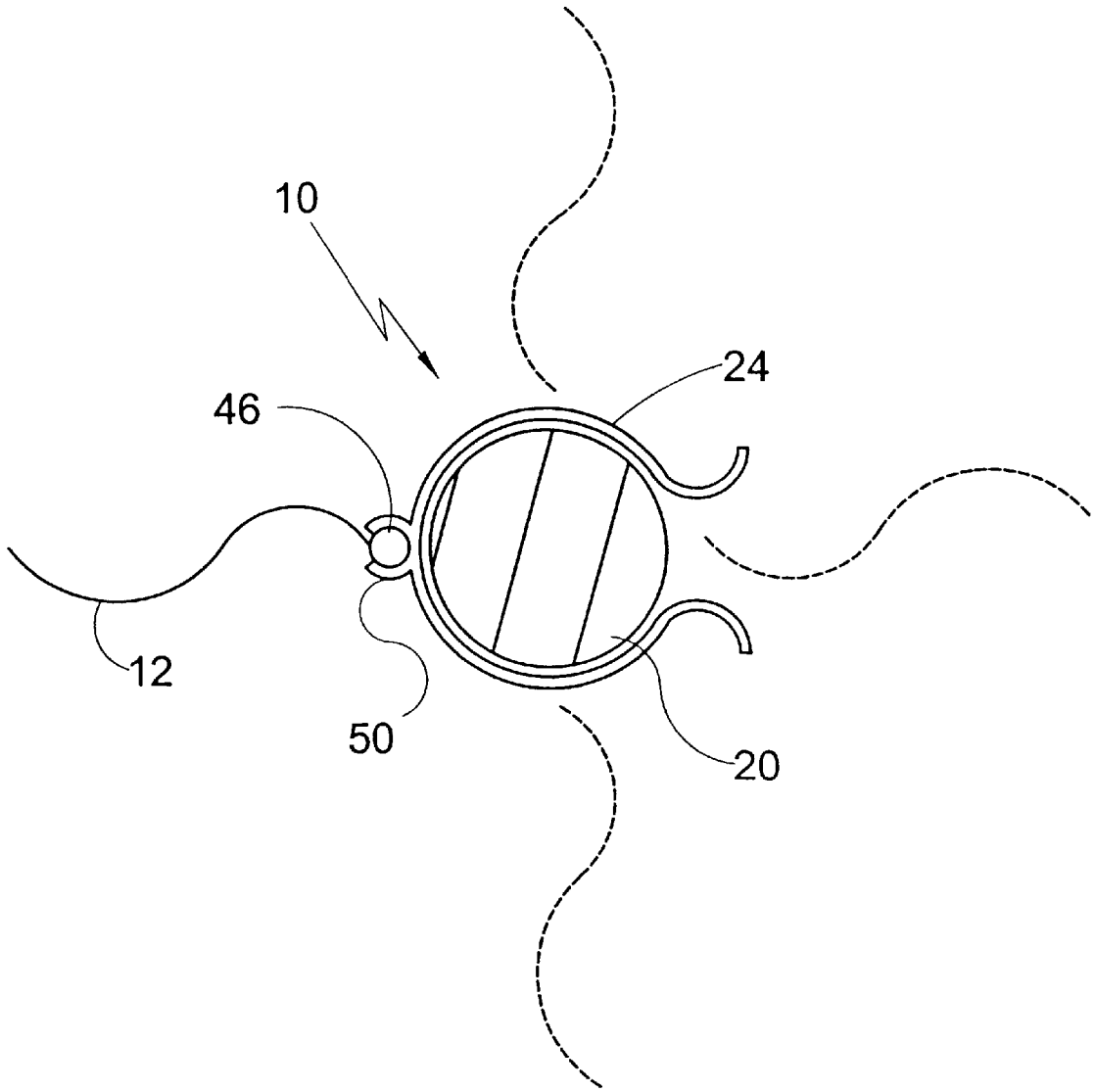
FIG. 11 is a section view of the present invention attached to a golf club shaft by a retaining clip.

Turning to FIG. 11, shown therein is a view of the sound generation device of the present invention 10 attached to a sporting equipment shaft 20. The sound generation device is comprised of a sound generation element 12 having a length of semi-rigid pliant material fixedly attached to a post 46 which forms a sound generation attachment element mating member for insertion into a small clip 50 on the back of the large clip 24.

Figure 12:
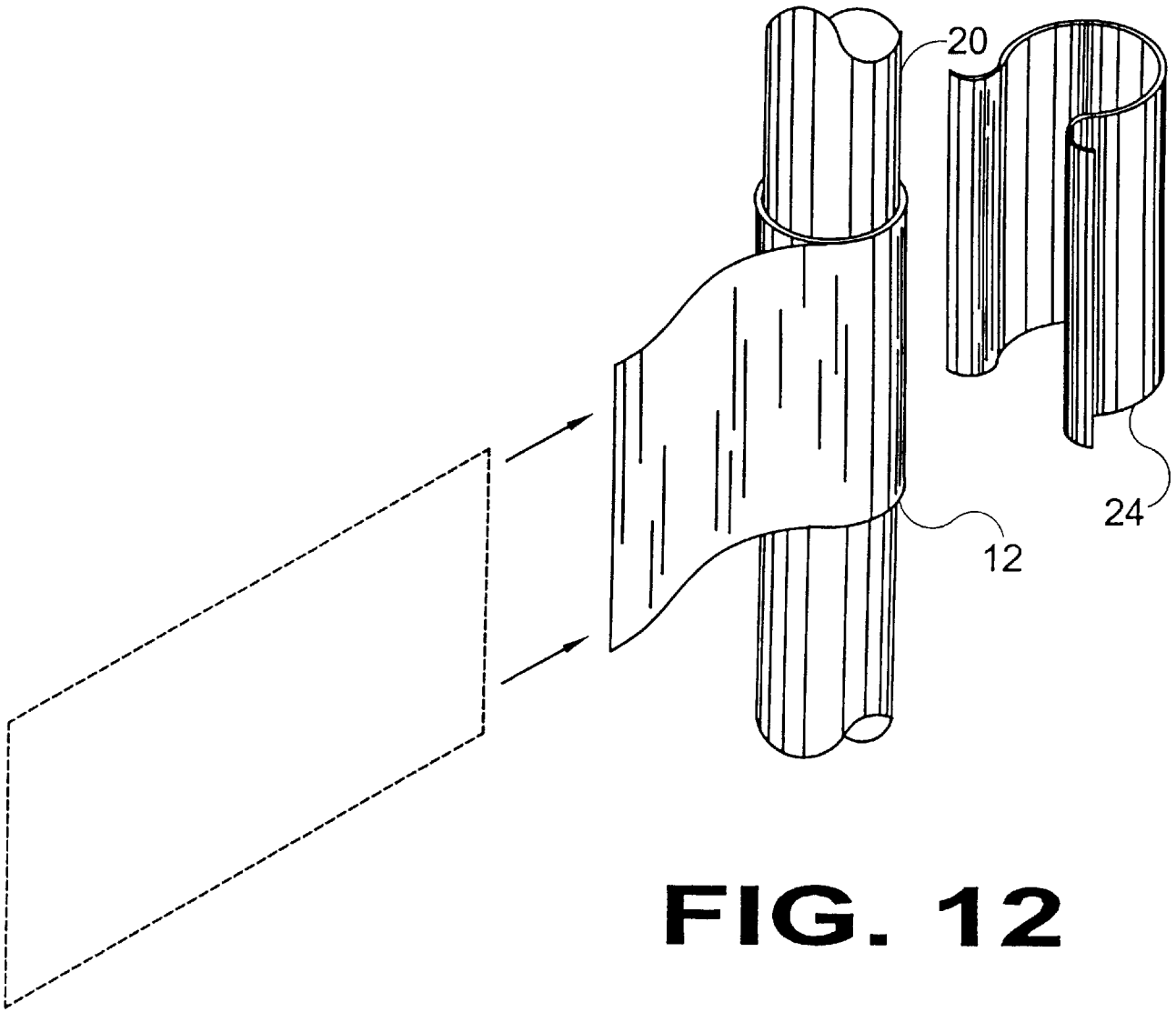
FIG. 12 is a perspective view of the sound generation element wrapped around a golf shaft with a retaining clip.

Turning to FIG. 12, shown therein is a perspective view of the sound generation device partially mounted onto a sporting equipment shaft 20. The sound generation device is comprised of a sound generation element 12 and a mounting element 24. The sound generation element 12 can be wrapped around the sporting equipment shaft until a desired length of the sound generation element is exposed, whereupon the clip attachment element 24 is pressed onto the shaft 20 over the sound generation element movably fixedly positioning the sound generation element a desired length onto the sporting equipment shaft 20.

Figure 13:
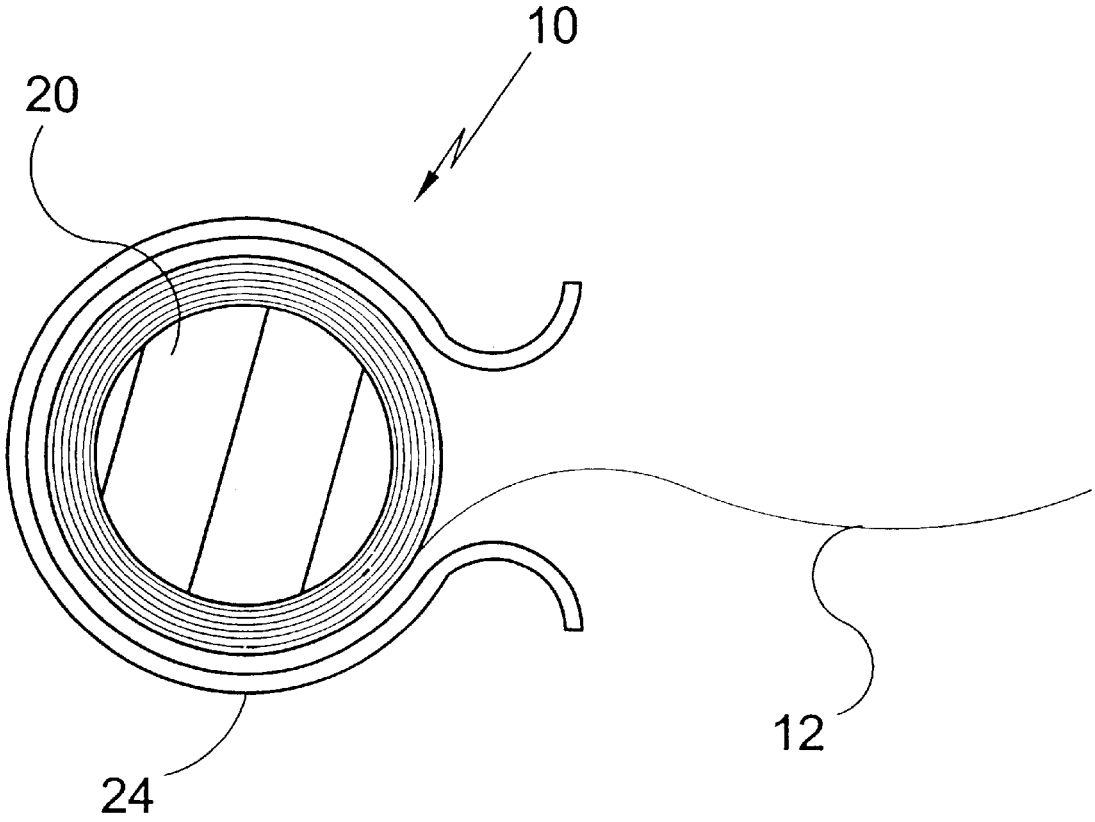
FIG. 13 is a sectional view of the present invention wrapped around a golf shaft with a retaining clip.

Turning to FIG. 13, shown therein is a view of the sound generation device of the present invention 10 attached to a shaft 20. The sound generation element 12 is wrapped around the shaft 20 until a desired length of sound generation element is exposed. The sound generation attachment element 24 holds the sound generation element 12 at the aforementioned selective positioning onto the sporting equipment shaft 20.

Figure 14:
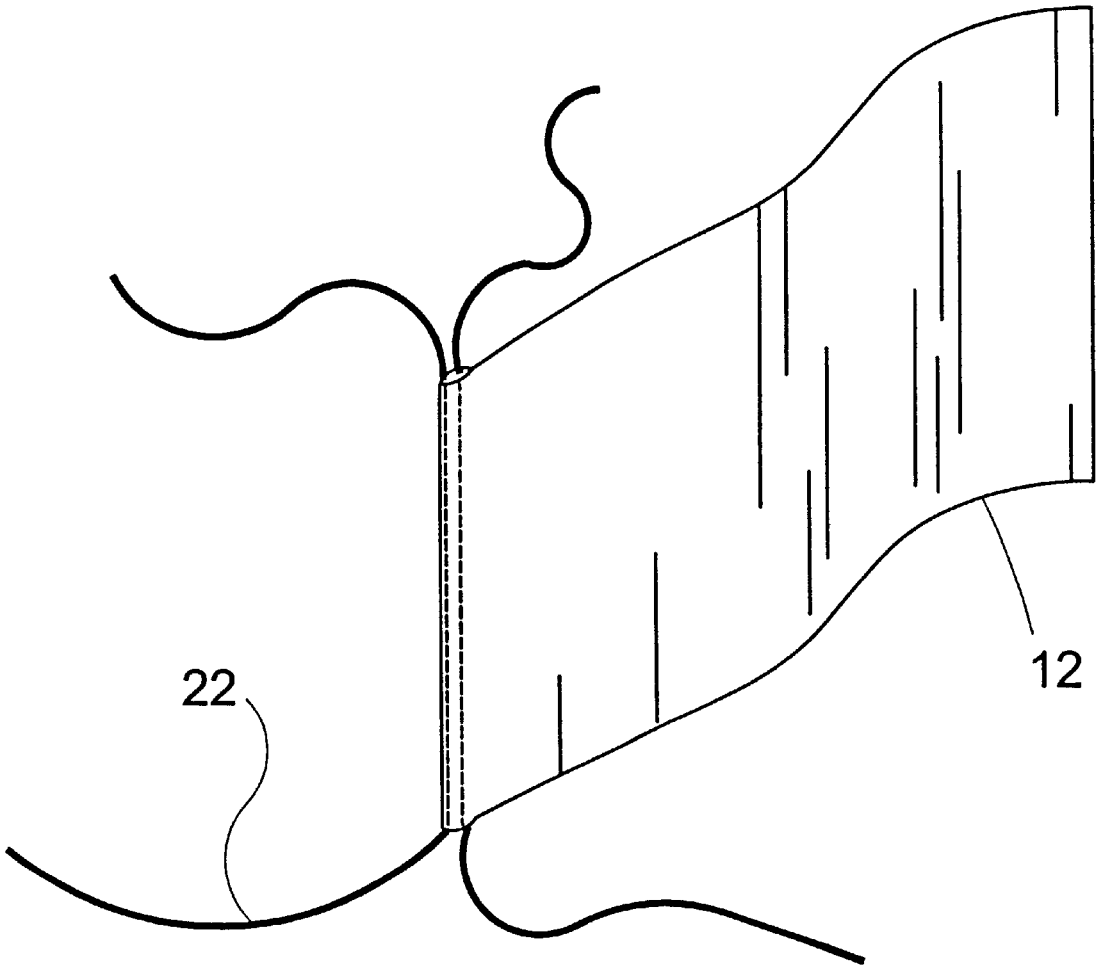
FIG. 14 is a perspective view of the sound generation device attached to means for ties.

Turning to FIG. 14, shown therein is a perspective view of the sound generation device comprised of a sound generation element 12 and a sound generation attachment means forming an integral part therewith. The sound generation device, as shown, is a semi-rigid planar pliant material fixed to multiple lengths of a suitable tying or twisting material, such as cord or wire reinforced cord 22. The sporting equipment is encircled by the opposing lengths of the tie material 22 positioned at each distal end. The lengths of line 22 are then tied or twisted around the portion of sporting equipment. This configuration enables the sound generation element 12 to be attached to irregular objects such as a tennis racquet. It also provides for selective attachment as need be.

Figure 15:
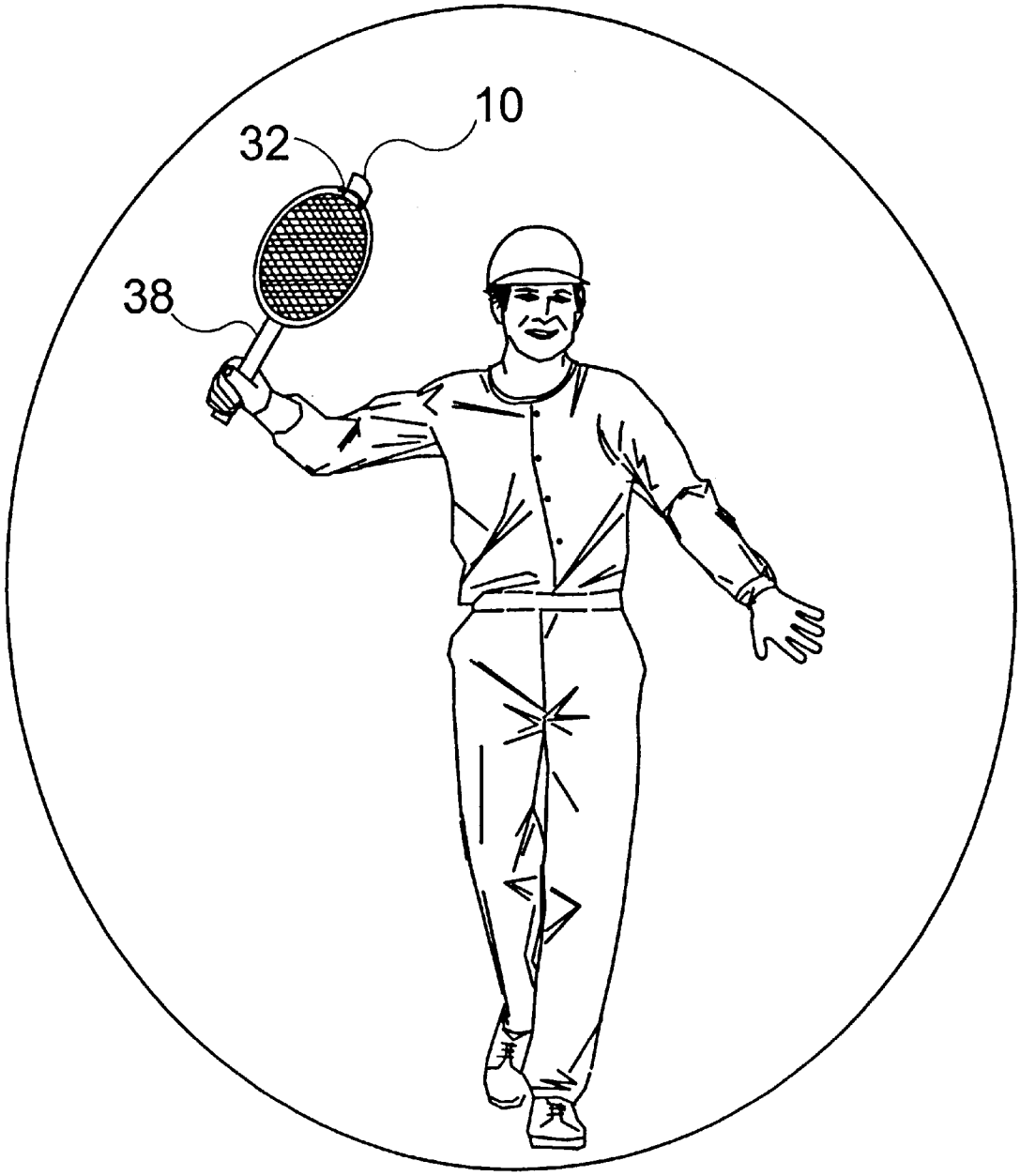
FIG. 15 is a perspective view of the sound generation element of the present invention attached to a tennis racquet.

Turning to FIG. 15, shown therein is a perspective view of the present invention 10 attached to a tennis racquet 38. The sound generation device 10 is comprised of a sound generation element detachably attached to the tennis racquet 38 by means of ties 22 forming an integral part of the sound generation element. The sound generation device will emit a sound during an accelerated jerky sweeping motion of the tennis racquet 38 as opposed to a smooth sweeping motion.

Figure 16:
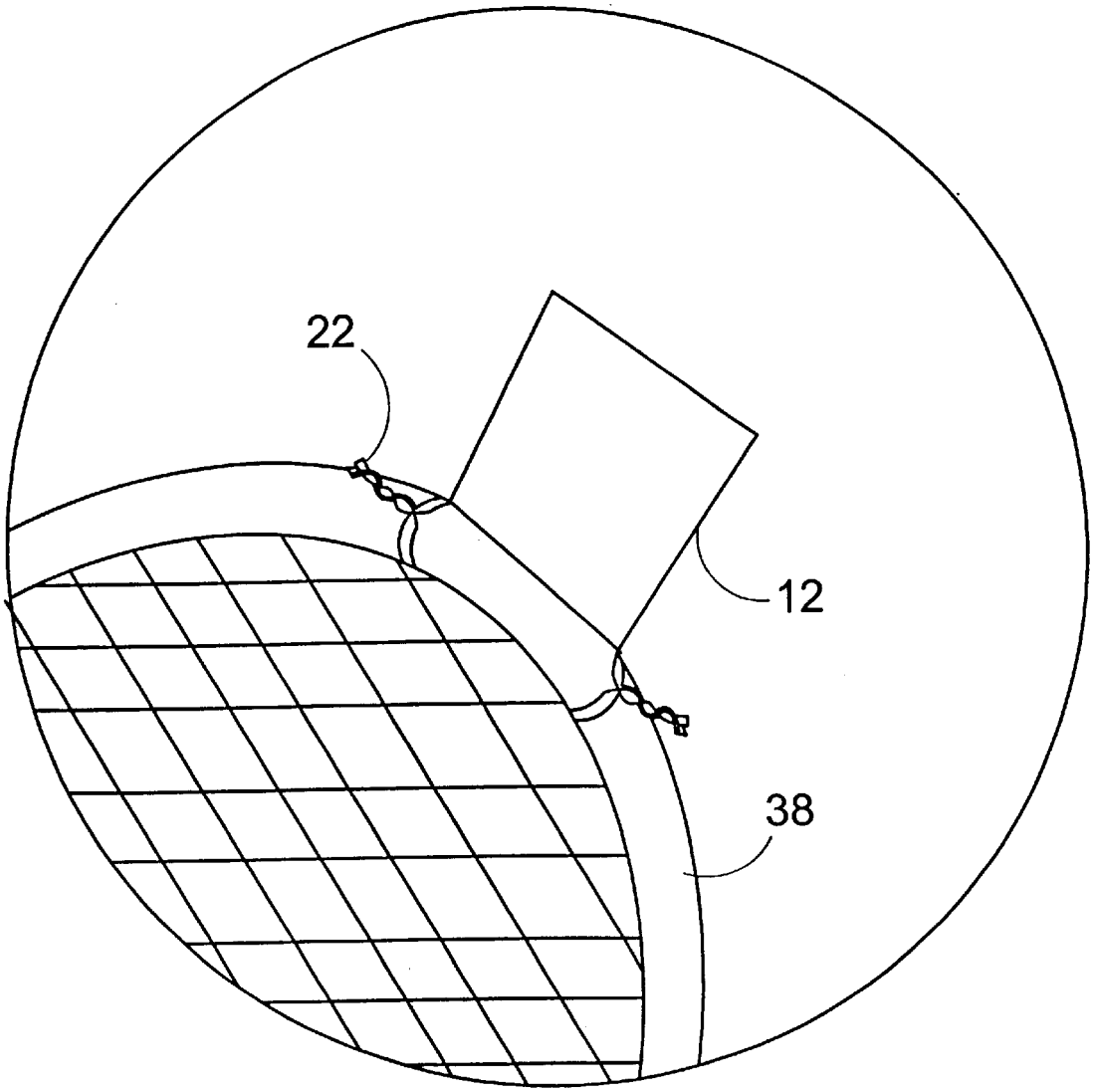
FIG. 16 is a perspective view of the sound generation device of the present invention attached to a tennis racquet.

Turning to FIG. 16, shown therein is a perspective view of the sound generation device of the present invention comprising a sound generation element 12 and a means of attachment element 22. The sound generation element is comprised of a semi-rigid pliant material attached to the rim of a tennis racquet 38 by ties 22.

I claim:

1. An apparatus comprising a sound generation element;

a first clip;

wherein the first clip can be attached to a shaft of a golf club;

wherein the sound generation element can be attached to the first clip to thereby attach the sound generation element to the shaft;

wherein the first clip can be attached to the shaft so that the first clip can freely rotate around the shaft; and wherein the first clip further comprises a pair of flexible arms, wherein said arms can encircle the shaft so as to secure said first clip to the shaft while allowing the clip to rotate with respect to the shaft.

2. The apparatus of claim 1, further comprising a post connected to the sound generation element;

wherein said first clip has a vertically disposed slot therein, said slot disposed on a wall of said clip opposite to said pair of flexible arms;

and wherein the post can be inserted into the vertically disposed slot of the first clip to attach the sound generation element to the first clip.

3. The apparatus of claim 2, wherein said sound generation element is connected to a side of said post.

4. The apparatus of claim 1, further comprising a second clip disposed on a wall of said first clip opposite to said pair of arms, wherein the second clip is smaller than the first clip;

further comprising an elongated post connected to the sound generation element for insertion into said smaller second clip.

5. An apparatus comprising a sound generation element;

a first clip;

wherein the first clip can be attached to a shaft of a golf club, wherein the golf club includes a golf club head which is located at an end of the golf club shaft;

wherein the sound generation element can be attached to the first clip to thereby attach the sound generation element to the shaft;

wherein the first clip can be attached to the shaft so that the first clip can freely rotate around the shaft; and wherein the first clip can attach the Sound generation element to the shaft so that the sound generation element can freely slide down the shaft; and wherein, the first clip can attach the sound generation element to the shaft so that the golf club head prevents the sound generation element from sliding off of the shaft.

6. An apparatus comprising a sound generation element;

a first clip;

wherein the first clip can be attached to a shaft of a golf club wherein the golf club includes a golf club head which is located at an end of the golf shaft;

wherein the sound generation element can be attached to the first clip to thereby attach the sound generation element to the shaft;

wherein the first clip can be attached to the shaft so that the first clip can freely rotate around the shaft; and wherein the first clip further comprises a pair of flexible arms, and said arms can encircle the shaft so as to secure said first clip to the shaft while allowing the clip to slide with respect to the shaft; and wherein, the first clip can attach the sound generation element to the shaft so that the golf club head prevents the sound generation element from sliding off of the shaft.

7. The apparatus of claim 6, further comprising a post connected to the sound generation element;

wherein said first clip has a vertically disposed slot therein, said slot disposed on a wall of said clip opposite to said pair of flexible arms;

and wherein the post can be inserted into the vertically disposed slot of the first clip to attach the sound generation element to the first clip.

8. The apparatus of claim 7, wherein said sound generation element is connected to a side of said post.

9. The apparatus of claim 6, further comprising a second clip disposed on a wall of said first clip opposite to said pair of arms, wherein the second clip is smaller than the first clip;

further comprising an elongated post connected to the sound generation element for insertion into said smaller second clip.

* * * * *